US007458623B2

(12) United States Patent
Daniel

(10) Patent No.: US 7,458,623 B2
(45) **Date of Patent: *Dec. 2, 2008**

(54) WRAP FOR BUNDLING OBJECTS

(75) Inventor: Dianne C. Daniel, Dublin, OH (US)

(73) Assignee: Handle It LLC, Dublin, OH (US)

( * ) Notice: Subject to any disclaimer, the term of this patent is extended or adjusted under 35 U.S.C. 154(b) by 5 days.

This patent is subject to a terminal disclaimer.

(21) Appl. No.: 11/682,333

(22) Filed: Mar. 6, 2007

(65) Prior Publication Data

US 2007/0145758 A1 Jun. 28, 2007

Related U.S. Application Data

(63) Continuation of application No. 10/268,142, filed on Oct. 10, 2002, now Pat. No. 7,192,069, which is a continuation of application No. 09/602,169, filed on Jun. 22, 2000, now abandoned, which is a continuation of application No. 09/080,703, filed on May 18, 1998, now Pat. No. 6,113,170, which is a continuation of application No. 08/671,490, filed on Jun. 27, 1996, now Pat. No. 5,853,212.

(51) Int. Cl.
*A63C 11/02* (2006.01)

(52) U.S. Cl. ..... 294/147; 294/141; 294/165; 24/16 R

(58) Field of Classification Search ..... 294/141, 294/146, 147, 148, 150, 165, 166; 24/16 R, 24/16 PB, 17, 30.5 P, 30.5, 27, 300; 428/364, 428/372, 373, 375, 379, 398; 70/233
See application file for complete search history.

(56) References Cited

U.S. PATENT DOCUMENTS

| | | | |
|---|---|---|---|
| 2,061,817 | A | 11/1936 | Van Cleef |
| 2,118,875 | A | 5/1938 | Windheim |
| 2,530,695 | A | 11/1950 | Helmert |
| 2,542,601 | A | 2/1951 | Van Cleef |
| 3,257,054 | A | 6/1966 | Miesel |
| 3,426,393 | A | 2/1969 | Mead |
| 3,543,353 | A | 12/1970 | Meehan |
| 3,564,667 | A | 2/1971 | Parrick, III et al. |
| 3,757,429 | A | 9/1973 | Sumino |
| 3,768,711 | A | 10/1973 | Wilkinson |
| 3,947,927 | A | 4/1976 | Rosenthal |
| 3,960,302 | A | 6/1976 | Mazzoni |

(Continued)

FOREIGN PATENT DOCUMENTS

| | | |
|---|---|---|
| WO | WO 97/00117 | 1/1996 |

OTHER PUBLICATIONS

Zippy, no date, Child's toy foam rubber products.

(Continued)

*Primary Examiner*—Dean J Kramer
(74) *Attorney, Agent, or Firm*—Fish & Richardson P.C.

(57) ABSTRACT

An apparatus may include an elongate piece of first material having flexible qualities with a flexible strip of second, more rigid, and bendable material enclosed within the first material. The apparatus may be twist-tied around equipment for relatively easy transport or may also be used to secure items in place.

45 Claims, 2 Drawing Sheets

U.S. PATENT DOCUMENTS

| | | | | |
|---|---|---|---|---|
| 4,015,762 | A | | 4/1977 | Mendillo |
| 4,120,437 | A | | 10/1978 | Hara |
| 4,463,885 | A | | 8/1984 | Ball et al. |
| 4,483,470 | A | | 11/1984 | Cousins |
| 4,484,378 | A | | 11/1984 | Kimura et al. |
| 4,488,748 | A | | 12/1984 | Burkes |
| 4,531,661 | A | | 7/1985 | Santy |
| 4,540,006 | A | | 9/1985 | Collis |
| 4,553,779 | A | | 11/1985 | Shortridge |
| 4,641,454 | A | | 2/1987 | Ray et al. |
| 4,648,414 | A | | 3/1987 | Fox et al. |
| 4,666,417 | A | | 5/1987 | Hillman |
| 4,817,837 | A | | 4/1989 | Grover |
| 4,834,118 | A | | 5/1989 | Goeller |
| 4,856,689 | A | | 8/1989 | Shore |
| 4,915,996 | A | | 4/1990 | Curry |
| D310,909 | S | | 10/1990 | Brandtl |
| 5,054,299 | A | | 10/1991 | Maveety |
| 5,056,820 | A | | 10/1991 | Des Prez |
| 5,104,017 | A | | 4/1992 | Vandagriff |
| 5,190,336 | A | | 3/1993 | Palz |
| 5,199,135 | A | | 4/1993 | Gold |
| 5,234,370 | A | | 8/1993 | Shapero et al. |
| 5,437,401 | A | | 8/1995 | Seltzer |
| 5,468,036 | A | | 11/1995 | Brown |
| 5,498,190 | A | | 3/1996 | Ganson |
| 5,590,422 | A | | 1/1997 | Henderson |
| 5,664,589 | A | | 9/1997 | Black |
| 5,714,211 | A | | 2/1998 | Zinbarg et al. |
| 5,769,994 | A | | 6/1998 | Booz et al. |
| 5,799,672 | A | | 9/1998 | Hansbury |
| 5,916,006 | A | | 6/1999 | Ganson |
| 6,113,170 | A | * | 9/2000 | Daniel ..... 294/147 |

OTHER PUBLICATIONS

Kenmatic Industries, No Date, Hair care foam rubber product.
Actual embodiment of a Toober (cited in publications of underlying patent application by Daniel).
Actual embodiment of a Hair Twirler (cited in publications of underlying patent application by Daniel).
Verified Complaint for Damages and Injunctive Relief Jury Demand Endorsed Hereon and Civil Cover Sheet, Nov. 25, 2003.
Motion for Temporary Restraining Order and Preliminary Injunction, Nov. 25, 2003.
Defendant Kwiktwist Corporation's Answer, Affirmative Defenses, and Counterclaims, Dec. 18, 2003.
Plaintiff Handle It Limited Liability Company's Reply and Affirmative Defenses to Defendant's Counterclaims, Jan. 5, 2004.
Response to Plaintiff's Motion for Temporary Restraining, Jan. 2, 2004.
Order Denying Motion for Temporary Restraining Order and Preliminary Injunction, Feb. 13, 2004.
Request for Reexamination of U.S. Patent No. 6,113,170.
Reexamination exhibit—photograph of "Hair Twirler" and "Toober" construction toy.
Order Staying All Proceedings, United States District Court, Eastern District of Texas entered into the record on Aug. 17, 2004.
Order Granting Request for Ex Parte Reexamination of U.S. patent No. 6,113,170.
Office Action Mailed Mar. 17, 2006 for Application No. 90/007,077.
*Potts* v. *Creager*, 155, U.S. 597; 15 S. Ct. 194; 39 L. Ed. 275; 1895 U.S. Lexis 2109 (1895).
*Topliff* v. *Topliff and Another*, 145 U.S. 156; 12 S. Ct. 825,; 36 L. Ed. 658; 1892 U.S. Lexis 2128 (1892).
*Hobbs* v. *Beach*, 180 U.S. 383; 21 S. Ct. 409; 45 L. Ed. 586; 1901 U.S. Lexis (1901).
*Traitel Marble Co.* v. *U.T. Hungerford Brass & Copper Co.*, 18 F.2d 66; 1927 U.S. App. Lexis 1877 (2d Cir. 1927).
*H.C. White Co.* v. *Morton E. Converse & Son Co., et al.*, 20 F.2d 311; 1927 U.S. App. Lexis 2518 (2d Cir. 1927).
In Re Hans Oetiker, 977 F.2d 1443; 1992 U.S. App Lexis 25784; 24 U.S.P.Q.2d (BNA) 1443; 93 Daily Journal DAR 658 (1992).
Amendments by Patent Owner in Ex Parte Reexamination filed Apr. 17, 2006 in Reexam No. 90/007,077, Reexam filed Jun. 15, 2004.
Declaration by Jeffrey s. Standley filed in support of Amendment by Patent Owner in Ex Parte Reexamination filed Apr. 17, 2006 in Reexam No. 90/007,077, Reexam filed Jun. 15, 2004.
Affidavit Under 37 C.F.R. § 1.132 of Dianne C. Daniel filed in support of Amendment by Patent Owner in Ex Parte Reexamination filed Apr. 17, 2006 in Reexam No. 90/007,077, Reexam filed Jun. 15, 2004.

* cited by examiner

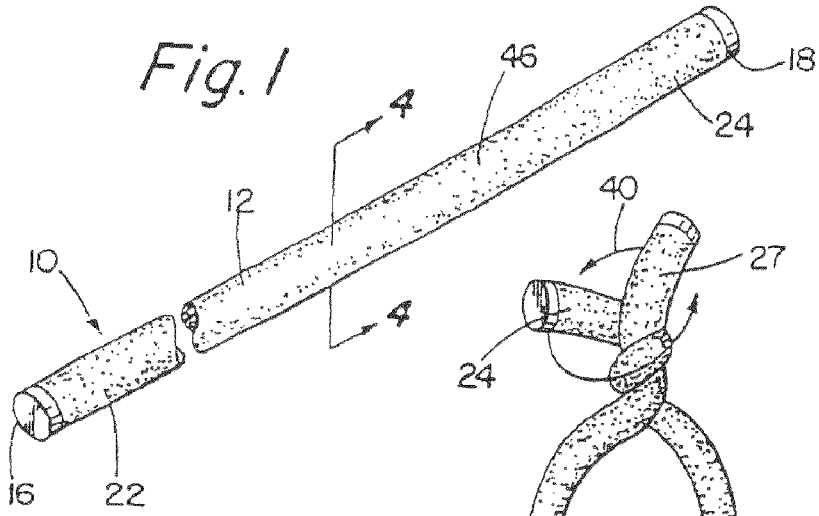
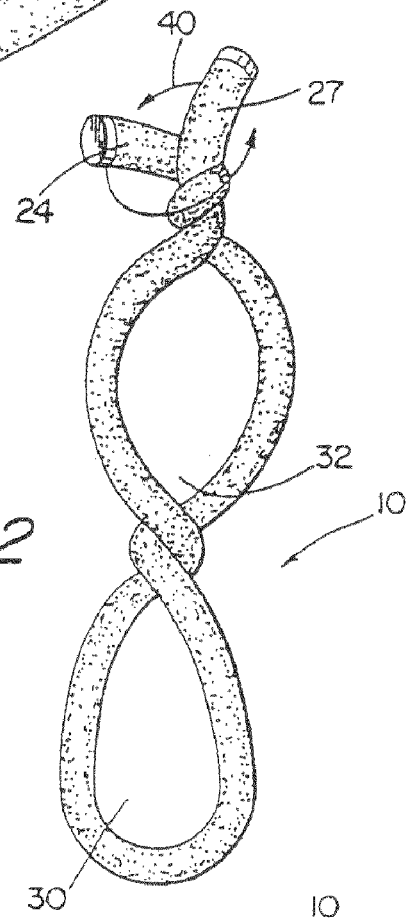
Fig. 2
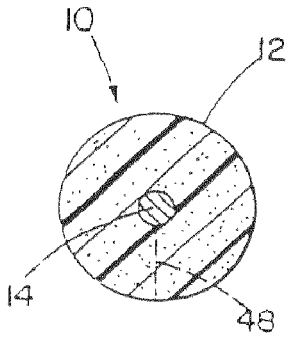
Fig. 4
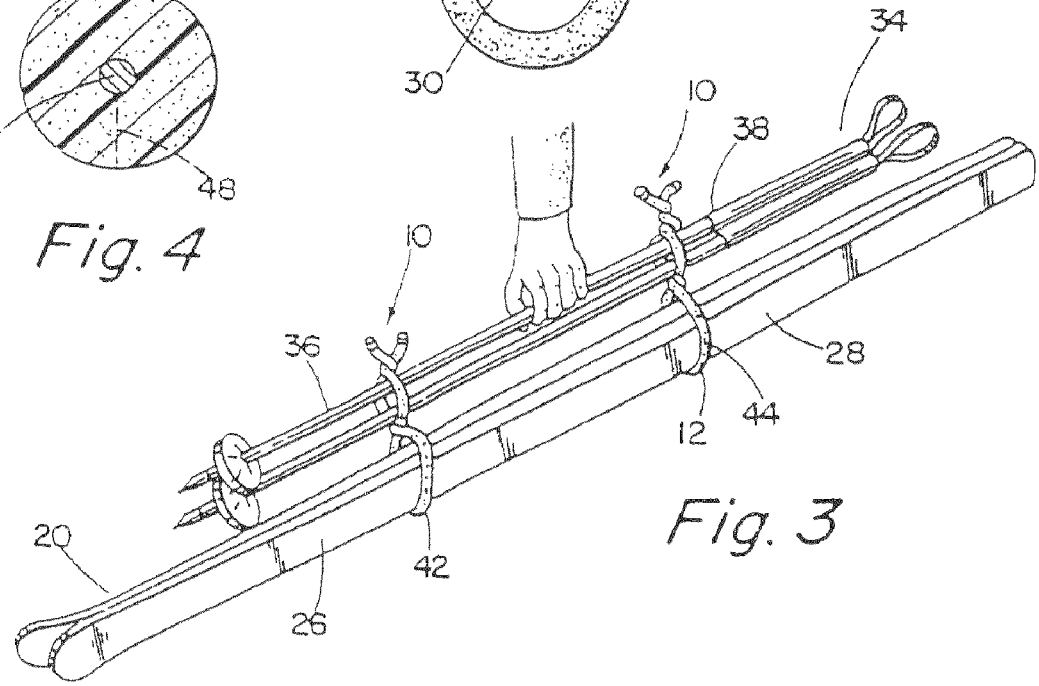
Fig. 3

WRAP FOR BUNDLING OBJECTS

This is a continuation of U.S. application Ser. No. 10/268,142, filed on Oct. 10, 2002, which is a continuation of U.S. application Ser. No. 09/602,169, filed Jun. 22, 2000, which is a continuation of U.S. application Ser. No. 09/080,703, filed May 18, 1998, now U.S. Pat. No. 6,113,170, which is a continuation of U.S. application Ser. No. 08/671,490, filed Jun. 27, 1996, now U.S. Pat. No. 5,853,212. The entirety of each of these references is hereby incorporated by reference.

BACKGROUND AND SUMMARY OF THE INVENTION

The present invention relates generally to equipment transportation devices and methods, and more particularly, to a snow ski wrap for easy transport of snow ski equipment.

The joys of snow skiing can often be shadowed by the difficulties of carrying and transporting the heavy and bulky skis and ski poles. Known ski equipment carrying devices such as those disclosed in U.S. Pat. Nos. 3,960,302, 4,888,748, 2,530,695, 3,257,054, 5,468,036, 2,118,875, 3,768,711, 4,120,437, 4,463,885, 4,015,762, 4,856,689, 5,190,336, 5,437,401, 4,531,661, and 3,947,927 require some sort of elaborate buckling, strapping, or Velcro-connecting means for carrying ski equipment. All these known devices are lacking because:

1) they require relatively time-consuming construction prior to use;
2) they cannot be easily used while wearing heavy snow gloves;
3) they are all relatively detailed in construction;
4) some fail to secure the ski equipment while also preventing scratch damage to the equipment; and
5) many known devices are not easily stored on the person while skiing.

The present invention is comprised of a tube-like, elongate piece of first material having characteristics including, but not limited to, soft, lightweight, and Flexible qualities, such as found in sponge (or foam) rubber (any variation of first materials of the rubber-like variety would work well depending on the application and/or particular manufacturing technique). The tube-like, elongate piece of first material encloses a flexible strip of second material having characteristics including, but not limited to, flexible qualities that allow the strip to retain its new shape when bent, such as a flexible wire. In an exemplary embodiment, the tube-like, elongate piece of first material is a sponge (or foam) rubber piece which can be easily grabbed, or handled, while wearing heavy ski gloves. The flexible strip is bendable which allows the elongate rubber piece to retain its shape when bent. The elongate rubber piece is then twisted together to secure the snow skis. A second ski wrap may be similarly used to secure the opposite end of the snow skis. A pair of ski poles may then be placed in the spaces formed by the twisting of the ski wraps securing the snow skis. The ski wraps may again be twisted to secure the ski poles in place. The skier may then grab the ski poles and easily transport the ski equipment.

The rubber material preferably has a non-slip exterior surface which allows the ski equipment to be secured within the invention. Additionally, the rubber wrap does not scratch the expensive ski equipment while in contact with the equipment. The rubber wrap also slightly elevates the ski equipment from the ground which prevents damage to the ski equipment by abrasive asphalt or gravel.

The efficient design of the snow ski wrap allows for relatively easy manufacture. The design of the present invention also allows for easy maintenance and storage of the ski wrap when not in use. When not in use, the present invention may be stored in a user's pocket while skiing.

The present invention provides a much-needed apparatus and method of easily securing and carrying ski equipment as well as other apparatus. In addition to the features mentioned above, objects and advantages of the present invention will be readily apparent upon a reading of the following description.

BRIEF DESCRIPTION OF THE DRAWINGS

Novel features and advantages of the present invention, in addition to those mentioned above, will become apparent to those skilled in the art, from a reading of the following detailed description in conjunction with the accompanying drawings wherein similar reference characters refer to similar parts and in which:

FIG. 1 is a perspective view of an exemplary embodiment of the apparatus of the present invention;

FIG. 2 is a plan view of the apparatus of FIG. 1 in a twisted shape;

FIG. 3 is a perspective view of the apparatus of FIG. 1 in use;

FIG. 4 is a cross sectional taken along lines 4-4 in FIG. 1;

DETAILED DESCRIPTION OF THE EXEMPLARY EMBODIMENTS

Figure 5:
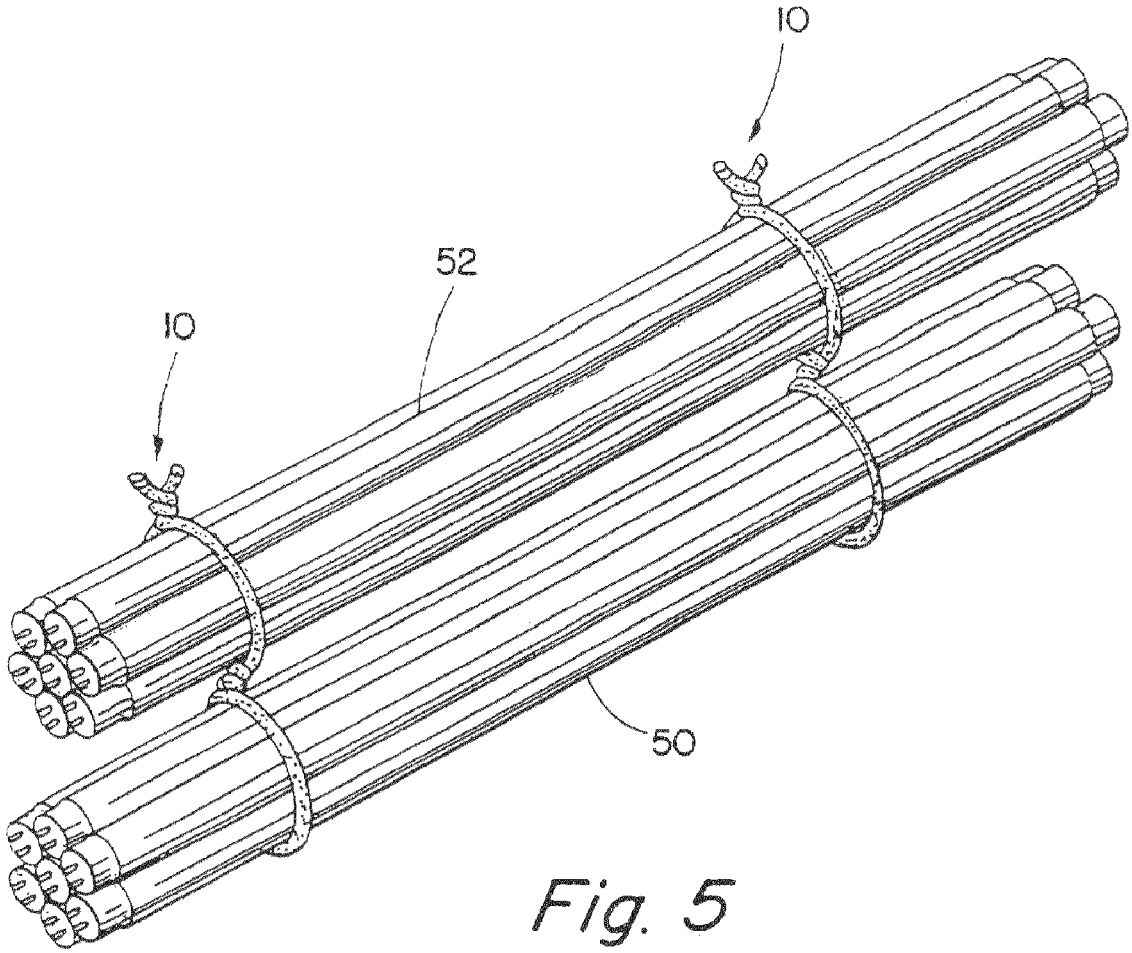
FIG. 5 is a perspective view of an exemplary embodiment of the present invention in use as a bundling apparatus.

An exemplary system herein described is not intended to be exhaustive or to limit the invention to the precise forms disclosed. They are chosen and described to explain the principles of the invention, and the application of the method to practical uses, so that others skilled in the art may practice the invention.

The present invention is comprised of a tube-like, elongate piece of first material 12 having characteristics including, but not limited to, soft, lightweight, and flexible qualities, such as found in sponge (or foam) rubber (any variation of first materials of the rubber-like variety would work well depending on the application and/or particular manufacturing technique). The tube-like, elongate piece 12 of first material encloses a flexible strip 14 of second material having characteristics including, but not limited to, flexible qualities that allow the strip 14 to retain its new shape when bent, such as a flexible wire. In an exemplary embodiment, the tube-like, elongate piece 12 of first material is a sponge (or foam) rubber piece 12, and the flexible strip 14 of second material is a strip 14 of flexible metal.

Referring in more detail to the drawings, and particularly FIG. 1, an exemplary embodiment of the snow ski wrap 10 of the present invention is comprised of a tube-like, elongate piece of sponge, or foam, rubber 12, a strip 14 of flexible metal enclosed within the length of the elongate piece of foam rubber 12, and a first end cap 16 placed over the first end 22 of the elongate piece of foam rubber 12, and a second end cap 18 placed over the opposite end 24 of the elongate piece of foam rubber 12.

It may be preferred that the elongate piece of foam rubber 12 be formed of a long tube-like form, preferably between 10 to 50 inches long, as illustrated in FIG. 1. It may also be preferred that the elongate piece of foam rubber 12 have a diameter between 0.5 inch to 2.5 inches so that the snow ski wrap 10 is capable of being easily grabbed and manipulated while a user is wearing heavy ski gloves. Several well known manufacturing methods may be used to produce the present invention. An exemplary method is to co-extrude the rubber piece 12 onto the flexible strip 14.

The flexible strip 14 of metal can be easily bent, yet the strip 14 has a degree of rigidity which allows the snow ski wrap 10 to retain its form when bent or straightened. In an exemplary embodiment, the strip 14 is a solid, 14 gauge, wire. FIG. 4 illustrates a cross-section of one end of the ski wrap 10, showing the enclosed strip 14 of wire.

The ski wrap 10 may be used by straightening the foam rubber piece 12 as illustrated in FIG. 1. Next the skier may place the two skis 20 together, as illustrated in FIG. 3. The skier may then take the ski wrap 10 of the present invention and grab the ends 22, 24 of the foam rubber piece 12 and wrap the elongate piece of foam rubber 12 around the first ends 26 of the two skis 20. The skier/user may then "twist-tie" the foam rubber piece 12 around the first ends 26 of the two skis. Twist-tying refers to interlocking the foam rubber piece 12 by twisting the ends 22, 24 of the foam rubber piece 12 together in the direction of the arrows 40 in FIG. 2. (The ends 22, 24 can also be twisted in the opposite direction of the arrows 40).

The skier/user may then wrap and twist-tie a second ski wrap 10 around the second ends 28 of the skis 20. This twist-tying motion creates a loop or hole 30 in which the skis 20 are secured. This twist-tying motion may also create a space 32 in which the ski poles 34 can be placed. The skier/user may then place a pair of ski poles 34 in the space 32 formed by the twist-tying of the elongate pieces of foam rubber 12. The ski poles 34 may be secured in place by wrapping and twist-tying the elongate pieces of foam rubber 12 a second time around the ends 36, 38 of the pair of ski poles 34.

The skier/user may carry the ski equipment by grasping the ski poles 34 between the first and second elongate pieces of foam rubber (42, 44 respectively).

The present invention is also unique as the elongate piece of foam rubber 12 has a non-slip exterior 46 in contact with the skis 20 and ski poles 34. The non-slip exterior 46 firmly secures the ski equipment in place to prevent the equipment from falling out of the loops 30. The foam rubber also protects the ski equipment front being scratched by the carrying means. Other known ski carrying equipment utilize straps made of leather, or other material, which can scratch the surface of the ski equipment. In the present invention, the insulation provided by the foam rubber protects the finished surfaces of the ski equipment from damage while in transit. Not only does the present invention prevent scratching from the ski carrier, the snow ski wrap 10 may be used to keep the snow skis 20 off the abrasive ground or pavement. A snow ski wrap 10 is preferably made with a foam rubber piece 12 with a radius 48 large enough to elevate the skis 20 off the hard ground.

The present invention has other beneficial uses. More particularly, the present invention is capable of being used for bundling and carrying elongate articles. For example, the present invention 10 is capable of separately bundling rods, baseball bats, sticks of wood, garden hoses or practically any other elongate article.

As illustrated, the present invention 10 may be used to bundle articles in separate groups. For example, as illustrated by FIG. 5, the first loop may be used to bundle and carry rods of one type 50 while the second loop may be used to bundle and carry rods of a second type 52. The present invention 10 is unique as it may be easily grabbed and manipulated while wearing heavy gloves. Additionally, the foam rubber exterior 46 preferably protects the bundled articles from being scratched by the carrying means. As discussed above, the foam rubber may also insulate the bundled elongate articles, such as the rods 50, 52 illustrated in FIG. 5, from damage when placed on the ground.

Figure 6:
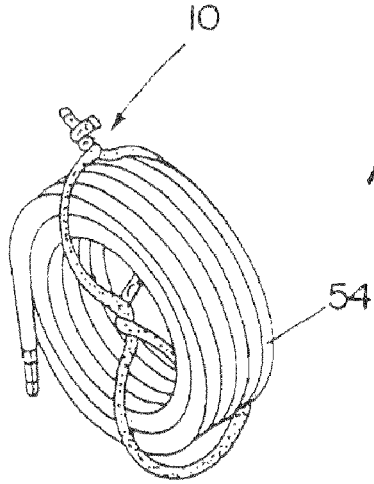
FIG. 6 is a perspective view of an exemplary embodiment of the l)resent invention in use as a garden hose restraint and carrying means.

FIG. 6 illustrates the present invention in use as a garden hose 54 restraint and carrying means. The present invention may also be used to secure items in place. For example, the present invention may be used to secure a bicycle to a bike rack.

Having shown and described an exemplary embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. An apparatus for securing articles, said apparatus comprising:

an elongate piece of first material having flexible qualities, the first material comprising soft foam material;

a strip of flexible material enclosed within the length of said elongate piece of first material, wherein the strip of flexible material comprises a metal wire, the soft foam material directly abutting the strip of flexible material;

a first end cap placed over a first end of said elongate piece of first material; and a second end cap placed over a second end of said elongate piece of first material;

wherein said strip of flexible material can be easily bent and has a degree of rigidity which allows said apparatus to retain its form when bent or straightened; and wherein said apparatus is adapted to be wrapped around a number of articles for securing said articles for storage or transport;

wherein said apparatus is at least ten inches in length so as to wrap around said articles for storage or transport.

2. The apparatus of claim 1 wherein said strip of flexible material is a solid metal wire.

3. The apparatus of claim 1 wherein said elongate piece of first material is of a sufficient thickness to cause articles being carried therein to be graspable from contact with a surface while wearing gloves.

4. The apparatus of claim 1 wherein said elongate piece of first material has a substantially non-slip exterior.

5. A method for using the apparatus of claim 1, the method comprising:

securing articles, independent of hair or a wig, by wrapping said apparatus around said articles and twist-tying end portions of said apparatus together.

6. The apparatus of claim 1, wherein the soft foam material is defined by a tubular shape having a length of at least 10 inches to about 50 inches, wherein the metal wire comprises a solid wire of about 14 gauge.

7. The apparatus of claim 1, wherein the soft foam material is co-extruded onto the strip of flexible material so as to engage the strip of flexible material.

8. The apparatus of claim 1, wherein said apparatus is adapted to wrap around said articles in a non-slip, soft, and non-scratch engagement.

9. The apparatus of claim 8, wherein said articles comprise an elongate piece of recreational equipment and an elongate piece of adjacent equipment.

10. A method of securing a plurality of elongate articles, said method comprising the steps of:

providing a first flexible strip of material adapted to be easily bent, said first flexible strip of material having a degree of rigidity which allows said first flexible strip of material to retain its form when bent or straightened, the first flexible strip of material being enclosed by a first elongate piece of flexible material, said first elongate piece of flexible material comprised of a soft foam material that directly abuts the first flexible strip of material, wherein said first elongate piece of flexible material is at least ten inches in length;

wrapping said plurality of elongate articles with said first elongate piece of flexible material;

twist-tying said first elongate piece of flexible material around said plurality of elongate articles;

providing a second flexible strip of material adapted to be easily bent, said second flexible strip of material having a degree of rigidity which allows said second flexible strip of material to retain its form when bent or straightened, the second flexible strip of material being enclosed by-a second elongate piece of flexible material, wherein said second elongate piece of flexible material is at least ten inches in length;

wrapping said plurality of elongate articles with said second elongate piece of flexible material a predetermined distance from said first elongate piece of flexible material; and twist-tying said second elongate piece of flexible material.

11. The method of claim 10, wherein the first and second elongate pieces of flexible material are wrapped around said plurality of elongate articles in a non-slip, soft, and non-scratch engagement.

12. The method of claim 11, wherein said plurality of elongate articles comprise an elongate piece of recreational equipment and an elongate piece of adjacent equipment.

13. The method of claim 10, wherein said first flexible strip of material comprises a metal wire.

14. The method of claim 13, wherein the first elongate piece of flexible material is co-extruded onto the first flexible strip of material so as to directly abut the first flexible strip of material.

15. The method of claim 10, wherein the first and second elongate pieces of flexible material each have a tubular shape extending at least 10 inches to about 50 inches in length, wherein the first and second flexible strips of material each comprise solid wire of about 14 gauge.

16. The method of claim 15, wherein each of the first and second elongate pieces of flexible material have end caps disposed at the free ends thereof.

17. A method of securing and transporting a plurality of elongate articles, said method comprising the steps of:

placing a plurality of elongate articles together;

wrapping and twist-tying a first elongate piece of flexible soft foam material around a first end of said plurality of elongate articles, said first elongate piece of flexible soft foam material enclosing a first flexible strip of material such that the first elongate piece of flexible soft foam material directly abuts the first flexible strip of material, wherein said first elongate piece of flexible soft foam material is at least ten inches in length;

wrapping and twist-tying a second elongate piece of flexible soft foam material around a second end of said plurality of elongate articles, said second elongate piece of flexible soft foam material enclosing a second flexible strip of material, wherein said second elongate piece of flexible soft foam material is at least ten inches in length;

grasping said plurality of elongate articles; and transporting said plurality of elongate articles.

18. The method of claim 17 wherein said plurality of elongate articles are grasped between said first and second elongate pieces of flexible material.

19. The method of claim 17, wherein the first and second elongate pieces of flexible soft foam material are wrapped around said plurality of elongate articles in a non-slip, soft, and non-scratch engagement.

20. The method of claim 19, wherein said plurality of elongate articles comprise an elongate piece of equipment and an elongate piece of adjacent equipment.

21. The method of claim 17, wherein said first flexible strip of material comprises a metal wire.

22. The method of claim 21, wherein the first elongate piece of flexible soft foam material is co-extruded onto the first flexible strip of material so as to directly abut the first flexible strip of material.

23. The method of claim 17, wherein the first and second elongate pieces of flexible soft foam material each have a tubular shape extending at least 10 inches to about 50 inches in length, wherein the first and second flexible strips of material each comprise solid wire of about 14 gauge.

24. A method of handling a plurality of elongate articles, said method comprising the steps of:

placing a plurality of elongate articles together;

wrapping and securing a first elongate piece of flexible soft foam material around a first end of said plurality of elongate articles, said first elongate piece of flexible soft foam material enclosing and insulating a thinner first flexible strip of material such that the first elongate piece of flexible soft foam material directly abuts the first flexible strip of material, wherein said first elongate piece of flexible soft foam material is at least ten inches in length; and wrapping and securing a second elongate piece of flexible soft foam material around a second end of said plurality of elongate articles, said second elongate piece of flexible soft foam material enclosing and insulating a thinner second flexible strip of material, wherein said second elongate piece of flexible soft foam material is at least ten inches in length.

25. The method of claim 24, wherein the first and second elongate pieces of flexible soft foam material are wrapped around said plurality of elongate articles in a non-slip, soft, and non-scratch engagement.

26. The method of claim 25, wherein said plurality of elongate articles comprise an elongate piece of equipment and an elongate piece of adjacent equipment.

27. The method of claim 24, wherein said first flexible strip of material comprises a metal wire.

28. The method of claim 27, wherein the first elongate piece of flexible soft foam material is co-extruded onto the first flexible strip of material so as to directly abut the first flexible strip of material.

29. The method of claim 24, wherein the first and second elongate pieces of flexible soft foam material each have a tubular shape extending at least 10 inches to about 50 inches in length, wherein the first and second flexible strips of material each comprise solid wire of about 14 gauge.

30. A system for securing articles, said system comprising:

a first elongate tie comprised of a first flexible soft foam material insulating member throughout the length of said first elongate tie and a second flexible material member, of a cross-section dimension less than said first flexible material member and a rigidity greater than said first flexible material, enclosed within the length of said first elongate tie, wherein the second flexible material member of the first elongate tie comprises a metal wire, the first flexible soft foam material directly abutting the second flexible material member;

a second elongate tie comprised of a third flexible soft foam material insulating member throughout the length of said second elongate tie and a fourth flexible material member, of a cross-section dimension less than said third flexible material member and a rigidity greater than said third flexible material, enclosed within the length of said second elongate tie;

wherein said first elongate tie and said second elongate tie are each at least ten inches in length and each are adapted to be wrapped around at least two elongate articles to secure said articles.

31. The system of claim 30, wherein said first flexible material and said third flexible material are foam rubber.

32. The system of claim 30, wherein said second flexible material and said fourth flexible material are metal strips.

33. The system of claim 30, wherein the first flexible soft foam material insulating member is defined by a tubular shape having a length of at least 10 inches to about 50 inches, wherein the metal wire comprises a solid wire of about 14 gauge.

34. The system of claim 30, wherein the first flexible soft foam material is co-extruded onto the strip of flexible material so as to engage the second flexible material member.

35. The system of claim 30, wherein the at least two elongate articles comprise an elongate piece of recreational equipment and an elongate piece of adjacent equipment.

36. A twist-tie system for securing adjacent equipment, the system comprising:

a first twist-tie device having a length of at least 10 inches and a diameter between about 0.5 inch and about 2.5 inches, the first twist-tie device comprising a first strip of flexible wire enclosed within a first soft foam member along the length of the first twist-tie device, wherein the first soft foam member is co-extruded onto the first strip of flexible wire so that the first soft foam member is adjacent to the first strip of flexible wire, a second twist-tie device having a length of at least 10 inches and a diameter between about 0.5 inch and about 2.5 inches, the second twist-tie device comprising a second strip of flexible wire enclosed within a second soft foam member along the length of the second twist-tie device, wherein the second soft foam member is co-extruded onto the second strip of flexible wire so that the second soft foam member is adjacent to the second strip of flexible wire, wherein said first twist-tie device and said second twist-tie device each have a degree of rigidity so as to retain its form when bent to wrap around an elongate equipment piece and a second adjacent equipment piece to twist-tie the equipment together.

37. The system of claim 36, wherein the soft foam member of each of the first and second twist-tie devices has a tubular shape extending a length of at least 10 inches to about 50 inches, wherein the strip of flexible wire of each of the first and second twist-tie devices comprises metal wire of about 14 gauge.

38. The system of claim 36, wherein the first soft foam member directly abuts the first strip of flexible wire without an intermediate layer therebetween.

39. The system of claim 36, wherein the first and second twist-tie devices are operable to physically wrap around the elongate equipment piece and the second adjacent equipment piece in a non-slip, soft, and non-scratch engagement.

40. The system of claim 36, wherein the elongate equipment piece and the second adjacent equipment piece comprise an elongate piece of recreational equipment and an elongate piece of adjacent equipment.

41. The system of claim 40, wherein the recreational equipment comprises a first ski equipment and wherein the adjacent equipment comprises a second ski equipment.

42. The system of claim 36, wherein the elongate equipment piece comprises an elongate rod member and the second adjacent equipment piece comprise a second elongate rod member.

43. The system of claim 36, further comprising end caps disposed at free ends of each of the first and second twist-tie devices.

44. The system of claim 36, wherein each of said first soft foam member and said second soft foam member comprises a soft foam material selected from the group consisting of foam rubber and sponge rubber.

45. The system of claim 36, wherein the strip of flexible wire of each of the first and second twist-tie devices comprises a metal wire.

* * * * *